US005971778A

United States Patent [19]

Larabell

[11] Patent Number: 5,971,778

[45] **Date of Patent: *Oct. 26, 1999**

[54] MEMORY STORAGE DEVICE BRACKET HAVING RELEASING AND EXTRACTING HANDLE

[75] Inventor: Henri J. Larabell, San Jose, Calif.

[73] Assignee: Silicon Gear Corporation, San Jose, Calif.

[ * ] Notice: This patent is subject to a terminal disclaimer.

[21] Appl. No.: 08/876,388

[22] Filed: Jun. 16, 1997

[51] Int. Cl.[6] ..... H01R 13/62

[52] U.S. Cl. ..... 439/157; 361/796

[58] Field of Search ..... 439/157; 361/796

[56] References Cited

U.S. PATENT DOCUMENTS 5,518,412 5/1996 Larabell ..... 439/157

*Primary Examiner*—Harold I. Pitts

*Attorney, Agent, or Firm*—Douglas A. Chaikin; Peninsula IP Group

[57] ABSTRACT

A bracket for removeably attaching a memory storage device to an equipment side includes a frame attachable to the memory storage device, the frame including a front portion, a first rail and a second rail. A handle is pivotally mounted to the front portion of the frame and includes a guide slot and, at one end thereof, an ejection member. A slide member has a catch at one end, and includes a travel member protruding therefrom, which travel member is inserted in the guide slot. As the handle is manually pivoted away from the front portion to an open position, the travel member travels within the guide slot causing the slide member to slide against the front surface, the catch to retract and the ejection member to pivot with the handle to eject the bracket from the slide.

20 Claims, 6 Drawing Sheets

MEMORY STORAGE DEVICE BRACKET HAVING RELEASING AND EXTRACTING HANDLE

BACKGROUND OF THE INVENTION

1. Field of the Invention

This invention relates to brackets which interconnect memory storage devices with a memory storage device system. More particularly, this invention relates to a memory storage device mounting bracket having a pivoting lever to facilitate ejection and retraction of a memory device from an equipment slide.

2. Previous Art

A host system (e.g. a computer system) often requires memory storage capacity to enable mass storage and access of data, software, etc. In some host systems, the concept of "hot swapping" of memory storage devices has been introduced. "Hot swapping" allows a memory storage device, typically a hard disk, to be removed from or connected to the host system while the host system continues to operate. During "hot swapping", the host system need not be shut down.

A host system typically includes a circuit board which physically attaches to a memory storage device, or a memory storage device controller. The circuit board has a multi-pin connector which electronically connects the memory storage device with the circuit board.

Memory storage device housings have been developed which include equipment slides and memory storage device brackets. The circuit board of the host system physically attaches to the slide. The bracket slides onto the slide to facilitate the rapid installation and removal of the memory storage device into and out of the slide. Accordingly, the bracket and slide align and interconnect memory storage devices with the circuit board of the host system.

One bracket currently known includes a pair of rails, a face and a folding door. The door rotates between open and closed positions. In the open position, the bracket may be inserted into or removed from the slide. In the closed position, the door aligns with the face and locks the bracket with the slide. Both ends of the door lock to hold the memory storage device with the equipment slide.

One disadvantage of this particular type of bracket is that there is no facility for aiding the removal of the memory storage device from the slide. In order to remove the memory storage device, one must grasp the memory storage device and exert considerable force, thereby risking damage to the connectors. What is desired is a bracket which is easily and safely removed from a slide both physically and electronically. What is also desired is a bracket which facilitates manual retraction and extraction of the bracket from the slide.

SUMMARY OF THE INVENTION

It is an object of the invention to provide an improved bracket which includes a pivoting handle which facilitates ejection of the improved bracket from its housing.

It is another object of the present invention to provide an improved bracket which facilitates manual extraction of the bracket from the slide.

These objects and those mentioned and which will become apparent below are achieved by providing a bracket for removeably attaching a memory storage device to an equipment slide, comprising:

a frame attachable to the memory storage device, the frame including a front portion, a first rail and a second rail;

a handle pivotally mounted to a front portion of the frame, the handle including an ejection member at one end thereof, the handle further including a guide slot;

a slide member having a catch at one end thereof, the slide member having a travel member protruding therefrom, the travel member being inserted in the guide slot, whereby, as the handle is manually pivoted away from the front portion to an open position, the travel member travels within the guide slot and causes the slide member to slide against the front portion, the catch to retract and the ejection member to pivot with the handle to thereby eject the bracket from the slide.

In one exemplary embodiment, the catch includes a substantially circular cutout, the cutout rendering the catch resiliently deformable.

In another exemplary embodiment, the handle is pivotally attached to the frame by a pivot member inserted within a corresponding bore in the frame member.

In another exemplary embodiment, the frame includes a slide member recessed channel to facilitate and constrain the travel of the slide member.

In one exemplary embodiment of the present invention, one portion of the handle is partially recessed within the frame and another portion of the handle is fully recessed within a front surface of the frame, so as to be flush therewith when the handle is in a closed position.

Another exemplary embodiment includes a face member having snap fit connectors to connect the face member to the front portion of the bracket, the face member constraining the travel of the slide member to slide substantially parallel to the frame front portion.

In yet another exemplary embodiment the face member includes a handle cutout portion and a front surface cutout portion to accommodate the handle and expose the front surface of the frame, respectively.

In still another embodiment, the guide slot includes an angled portion, and the slide member protruding from the slide member is capable of traveling within the guide slot and over the angled portion.

An advantage of these exemplary embodiments is that by manually pivoting the handle to an open position, the bracket is released from the equipment slide by the retraction of the catch and pushed away therefrom by the pivoting of the ejection member. The handle allows the easy manual extraction of the bracket from the slide.

Another advantage of these exemplary embodiments is that, by manually pivoting the handle away from the front portion, the travel member travels within the guide slot and causes the slide member to slide against the front portion, the catch to retract and the ejection member to pivot with the handle to eject the bracket from the slide. The handle locks to an open position as the traveling member travels over and past the angled portion of the guide slot. The handle, in its locked open position, allows the easy manual extraction of the bracket and attached drive from the equipment slide.

BRIEF DESCRIPTION OF THE DRAWINGS

For a further understanding of the objects and advantages of the present invention, reference should be had to the following Detailed Description of the Invention, taken in conjunction with the accompanying drawing, in which like parts are given like reference numerals and wherein.

DETAILED DESCRIPTION OF THE INVENTION

Figure 1:
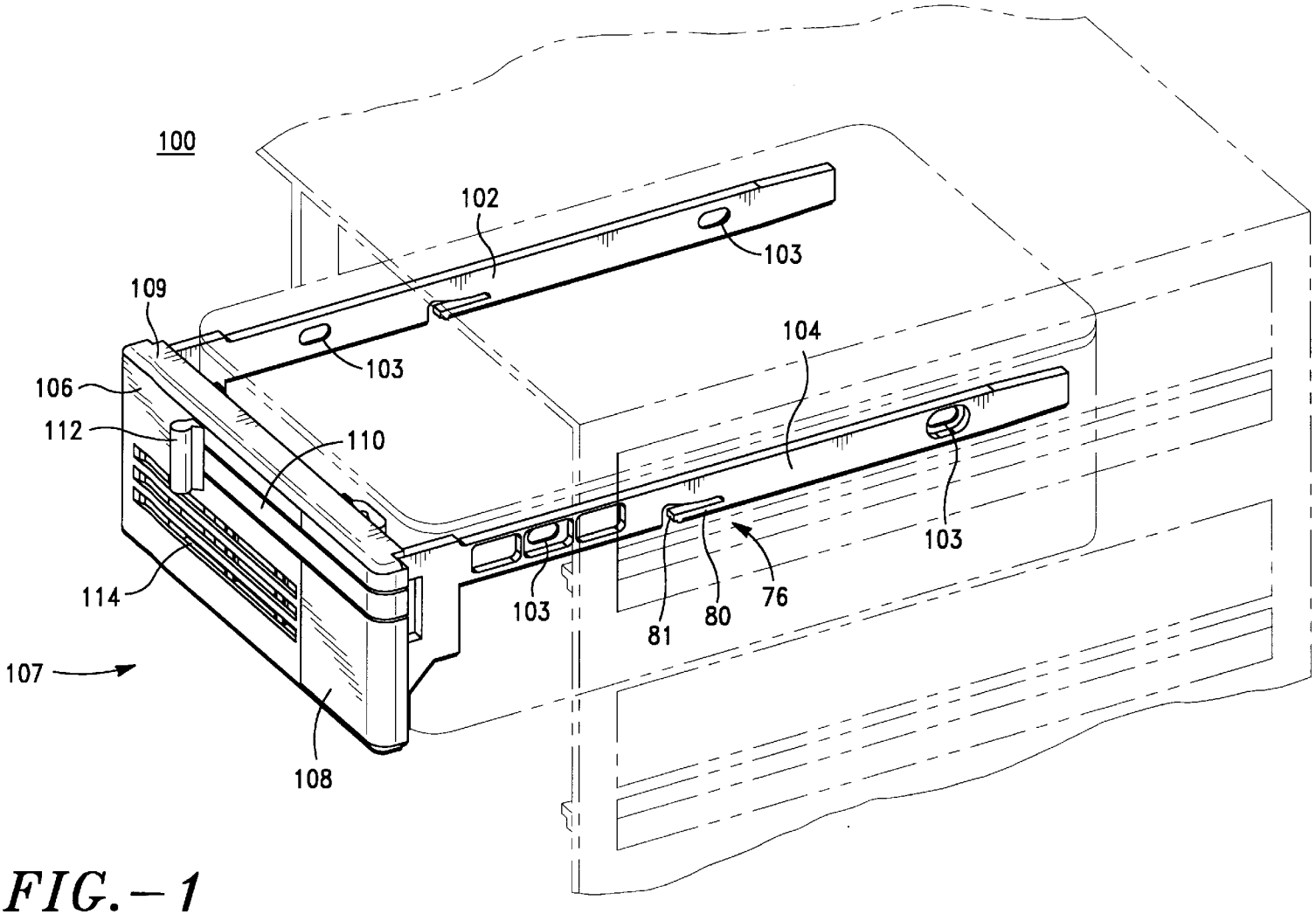
FIG. 1 shows a perspective view of the improved bracket having a memory storage device releasing and extracting handle, according to the present invention, mounted in an equipment slide.

With particular reference to FIG. 1, there is shown a bracket generally designated with the reference numeral 100. The bracket 100 removeably attaches a memory storage device to an equipment slide, shown in dashed lines in FIG. 1. The bracket 100 facilitates hot swapping of the memory storage device. The bracket 100 having a first rail 102 and a second rail 104. The rails 102 and 104 are attached to the frame member 109 and may be integral therewith. A memory storage device 150 may be attached to the bracket 100 by means of screws inserted through the openings 103 of the rails 102 and 104. A face member 106 is attached to the frame 109 by snap-fit or like connectors. The face member 106 has a cutout portion 105 (see FIG. 6) making the front surface 108 of the frame member 109 visible from the front portion 107 of the bracket 100.

Each of the rails 102 and 104 is rigid and elongated to slidably mate with an equipment slide. Each of the rails 102 and 104 includes a rail spring 76. The rail spring 76 is formed integral with each of the rails 102 and 104. The rail spring 76 tensions the rails 102 and 104 when the rails mate with the equipment slide. The rail spring 76 includes a finger 80 having a protuberance 81. The protuberance 81 eases the rail spring 76 into a secure position on the equipment slide. The rail spring 76 dampens vibrations between the equipment slide and the memory storage device.

The bracket 100 has a pivoting handle 110. The handle 110 is pivotally attached to the frame 109, so as to allow the handle to be pivoted away from the face member 106, to facilitate release of the bracket 100 from the slide, and to allow its manual extraction. The handle 110 includes a pull member 112 which is easy to grasp between the fingers of the user's hand. The face member 106 also includes a number of aeration slots 114. Of course, the design and appearance of the aeration slots can differ from that shown in FIG. 1, or may be omitted altogether, depending on design or other considerations.

Figure 2:
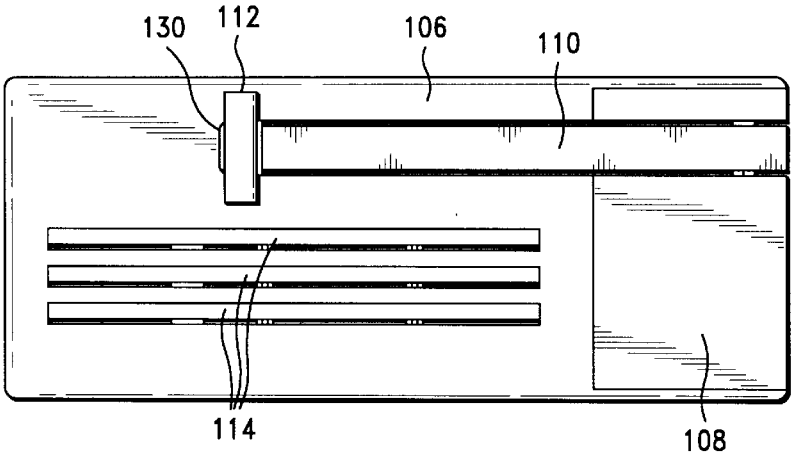
FIG. 2 shows a front view of the improved bracket according to the present invention.

FIG. 2 shows a front view of the improved bracket according to the present invention. As shown in FIG. 2, the pivoting handle 110 is mounted, in its closed position, flush to the face member 106 in a face member groove 130. Only the pull member 112 protrudes from the surface of the face member 106.

Figure 3:
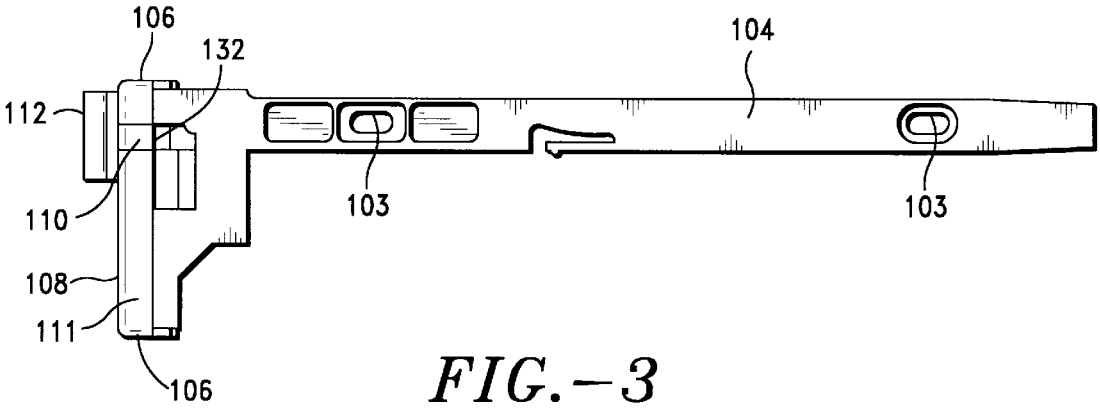
FIG. 3 shows a right side view of the improved bracket according to the present invention.

FIG. 3 shows a side view of the improved bracket according to the present invention. As shown in FIG. 3, although the pivoting handle 110 is mounted flush to the face member 106, the pull member 112 of the handle 110 protrudes from face member 106, to make it easy to grasp. The side surface 111 of the frame member front surface 108 is curved, as is one end of the pivoting handle 110 which forms the ejection member 137. The face member 106 is snap fit to the frame 109 (see FIG. 1), in such a manner as to mount it flush with the front surface 108. The front surface 108 is mounted within the cutout portion 105, shown in FIG. 6.

Figure 4:
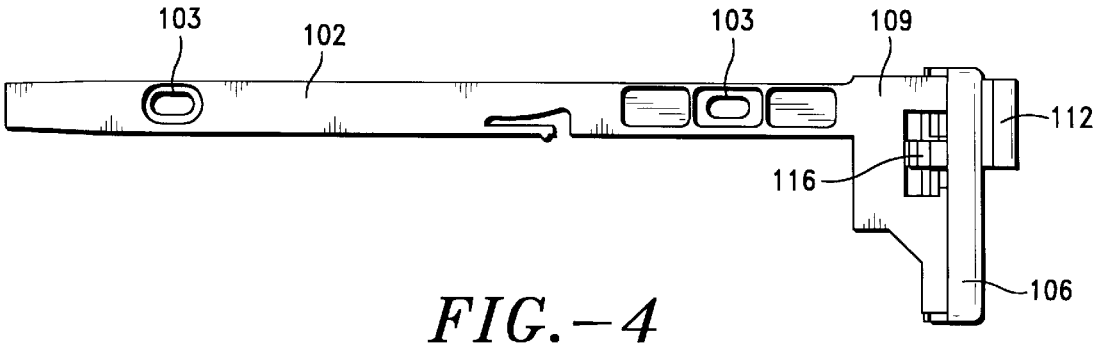
FIG. 4 shows a left side view of the improved bracket according to the present invention.

FIG. 4 shows another side view of the improved bracket according to the present invention. FIG. 4 shows the rail 102 attached to the frame 109. The face member 106 is snap fit to the frame 109, leaving the pull member 112 protruding therefrom. A catch 116 extends in parallel with the rails 102 and 104. The catch 116 catches a corresponding indentation or hole in the slide, so as to secure the bracket to the slide.

Figure 5:
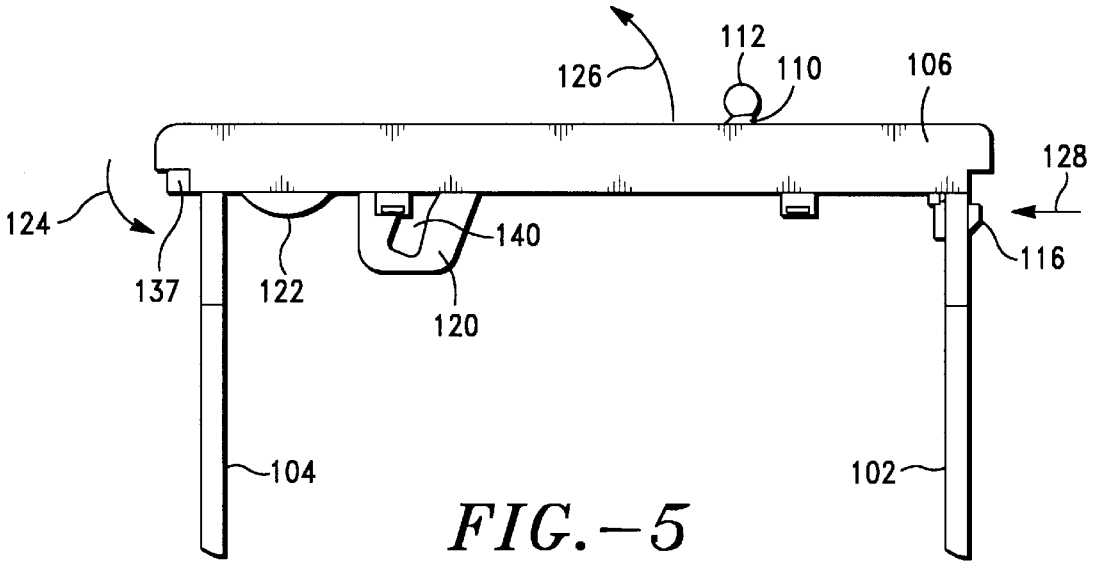
FIG. 5 shows a top plane view of the improved bracket according to the present invention.

FIG. 5 shows a top plane view of the improved bracket according to the present invention. FIG. 5 shows a guide member 120 having a guide slot 140 therein. The guide member is integrally formed with the pivoting handle 110. Also integral with the pivoting handle 1 10 is the ejection member 137. The catch 116 protrudes from the rail 102 and catches a corresponding indentation or hole in the slide to secure the bracket thereto. As the handle 110 is pivoted about pivot member 122 in the direction of arrow 126, the ejection member 137 pivots in the direction of arrow 124, whereas the catch 116 slides in the direction of arrow 128. In sliding in the direction of arrow 128, the catch 116 disengages from the corresponding indentation or hole in the slide, thereby releasing the bracket from the slide. In rotating in the direction of arrow 124, the ejection member 137 pushes against a corresponding front surface of the slide, thereby ejecting the bracket from the slide. This disconnects the mating electrical connectors on the slide and memory device, thereby allowing the easy extraction of the entire bracket and memory device assembly from the slide, by pulling on the pull member 112.

Figure 6:
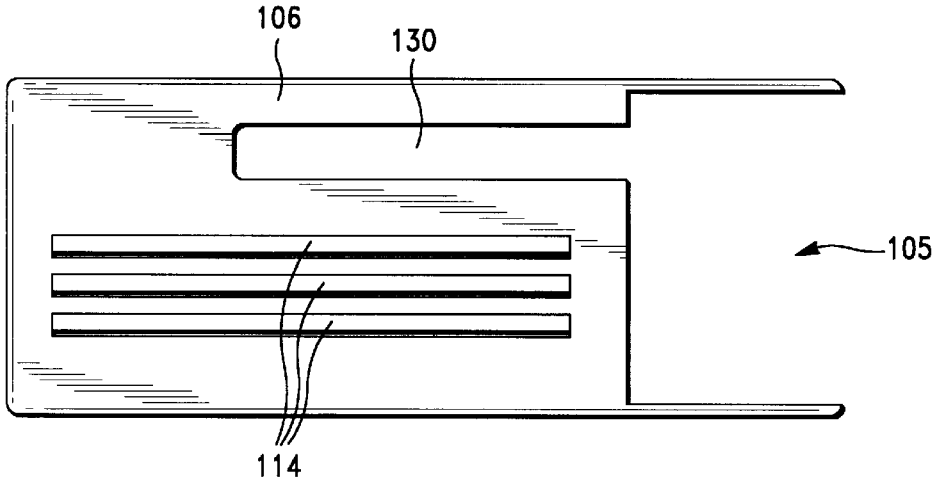
FIG. 6 shows a front view of the face member of the improved bracket according to the present invention.

FIG. 6 shows a front view of the face member 106, disconnected from the front portion of the bracket 100. The face member 106 has a handle cutout 130, thereby allowing the handle 110 to be flush with the face member, except for the pull member 112, when the handle 1 10 is in its closed position. The face member 106 also includes a front surface cutout portion 105, allowing the front surface 108 of the face member 106 to be exposed therethrough. A number of aeration vents 114 can also be seen in FIG. 6. The appearance and/or design of the aeration vents can be varied at will, as the skilled artisan will recognize. Alternatively, the aeration vents 114 may be omitted in their entirety.

Figure 7:
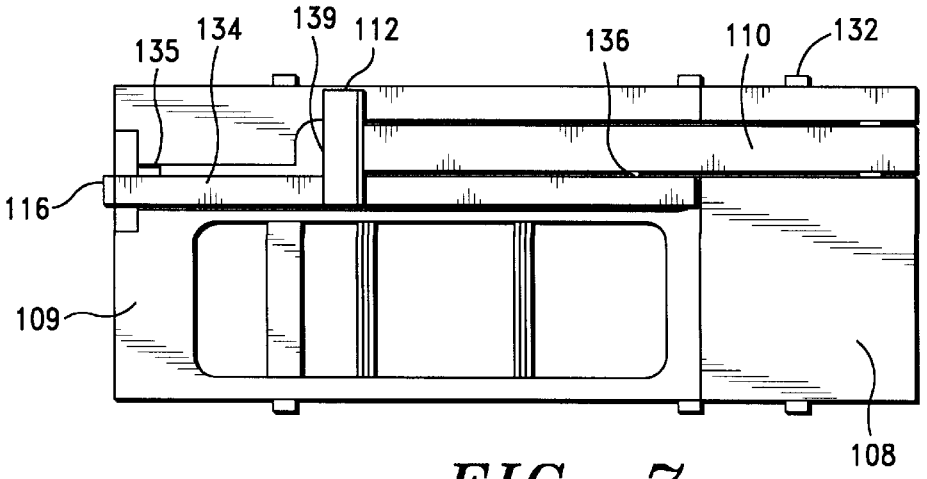
FIG. 7 shows a front view of the frame of the improved bracket according to the present invention.

FIG. 7 shows a front view of the bracket 100, with the face member 106 removed. As shown in FIG. 7, a slide member 134 is loosely connected to the pivoting handle 110 by means of travel member 136. The handle 110 is partially recessed within the front surface 108 of the frame 109 in handle recessed channel 139, whereas the slide member 134 is partially recessed within the front surface 108 of the frame 109 in slide member recessed channel 135. As can be seen in FIG. 7, the catch 116 protrudes from the side of the bracket 100 when the handle 110 is in its closed position. In this position the catch 116 will abut a corresponding indentation or hole in the equipment slide and secure the bracket and memory device assembly thereto. The handle 110 is pivotally attached to the frame 109 by means of pivot member 132 inserted within a corresponding bore within the frame 109.

Figure 8:
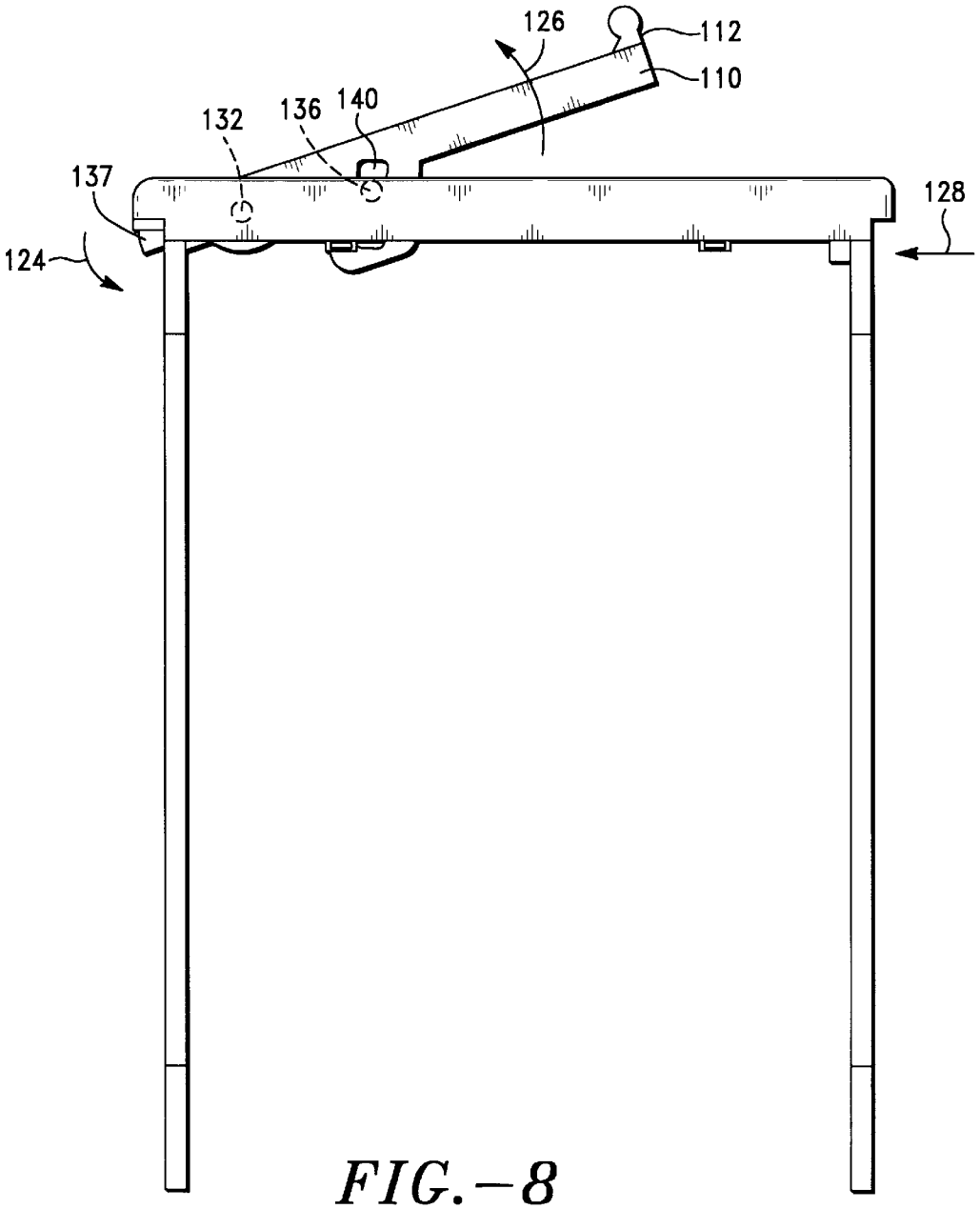
FIG. 8 shows a top plane view of the improved bracket according to the present invention, with the handle in the open position.

FIG. 8 shows a top plane view of the bracket 100 according to the present invention, with the face member 106 in place and the handle 110 in its open position. As the handle 110 is pivoted about pivot member 132 in the direction of arrow 126, the slide member, constrained in its motion by the slide member recessed channel 135 and the face member 106, slides in the direction of arrow 128, thereby retracting the catch 116 (shown in FIG. 5, retracted in FIG. 8) so that it no longer protrudes from the side of the bracket 100. This effectively releases the bracket assembly from the slide. Also, as the handle pivots in the direction of arrow 126, the ejection member 137 pivots in the direction of arrow 124, thereby pushing against a corresponding surface of the slide. This pushes the bracket assembly away from the slide, and facilitates its extraction therefrom. When the handle 110 pivots about the pivot member 132, the travel member 136 travels within the guide slot 140 of the handle 110. The path of this travel is such that the slide member 134, constrained in its motion by the combined influences of the slide member recessed channel 135 and the snap fit face member 106, slides in the direction of arrow 128.

Figure 9:
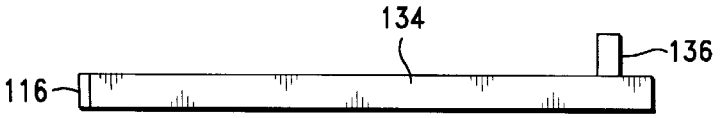
FIG. 9 shows a side view of the slide member of the improved bracket according to the present invention.

FIG. 9 shows a top plane view of the slide member 134, removed from the bracket 100. FIG. 9 shows a slide member 134 having a catch 116 at one end thereof and a travel member 136 proximate the other end thereof.

Figure 10:
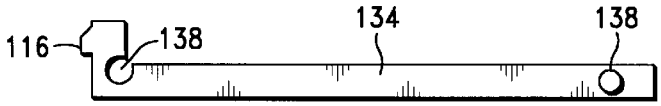
FIG. 10 shows another view of the slide member of the improved bracket according to the present invention, rotated 90 degrees from the view shown in FIG. 9.

FIG. 10 shows a side view of the slide member 134, rotated 90 degrees from the view of FIG. 9. As can be seen in FIG. 10, the catch 116 is formed orthogonally to the longitudinal axis of the slide member 134. The slide member 134 also includes a substantially circular cutout 138 rendering the catch 116 resiliently deformable when stressed by forces acting upon it.

Figure 11:
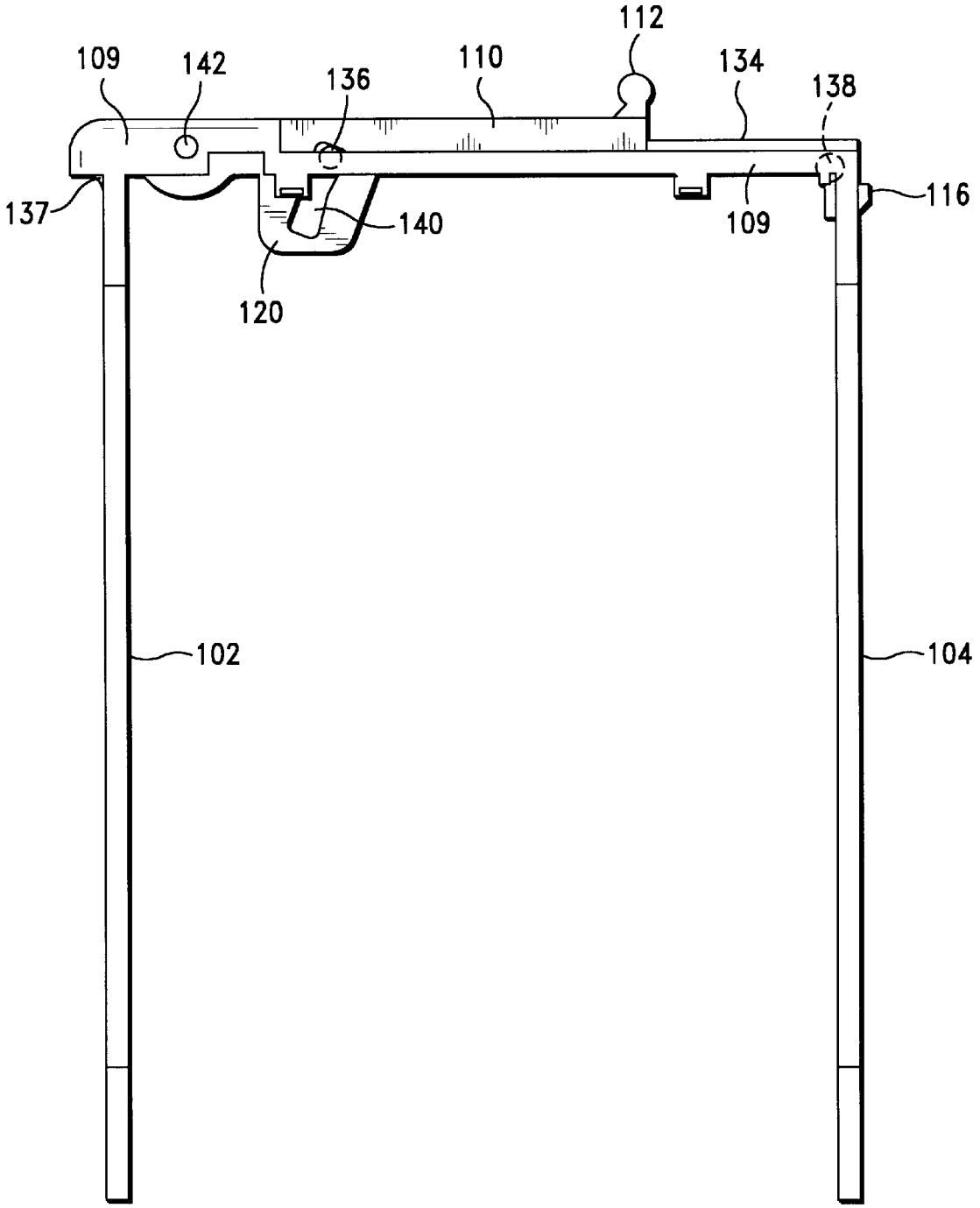
FIG. 11 shows a top plane view of the improved bracket according to the present invention, with the face member removed, and the handle in the closed position.

FIG. 11 shows a plane view of the improved bracket 100 according to the present invention, with the handle 110 in its closed position and with the face member 106 removed. In contrast to the view shown in FIG. 5, the substantially circular cutout 138 of the slide member 134 is clearly visible. Moreover, FIG. 11 shows the bore 142 within the frame 109 in which the pivot member 132 of the handle 110 is inserted, thereby allowing the handle 110 to pivot freely under the influence of a manually applied force acting on the pull member 112 of the handle 110.

Figure 12:
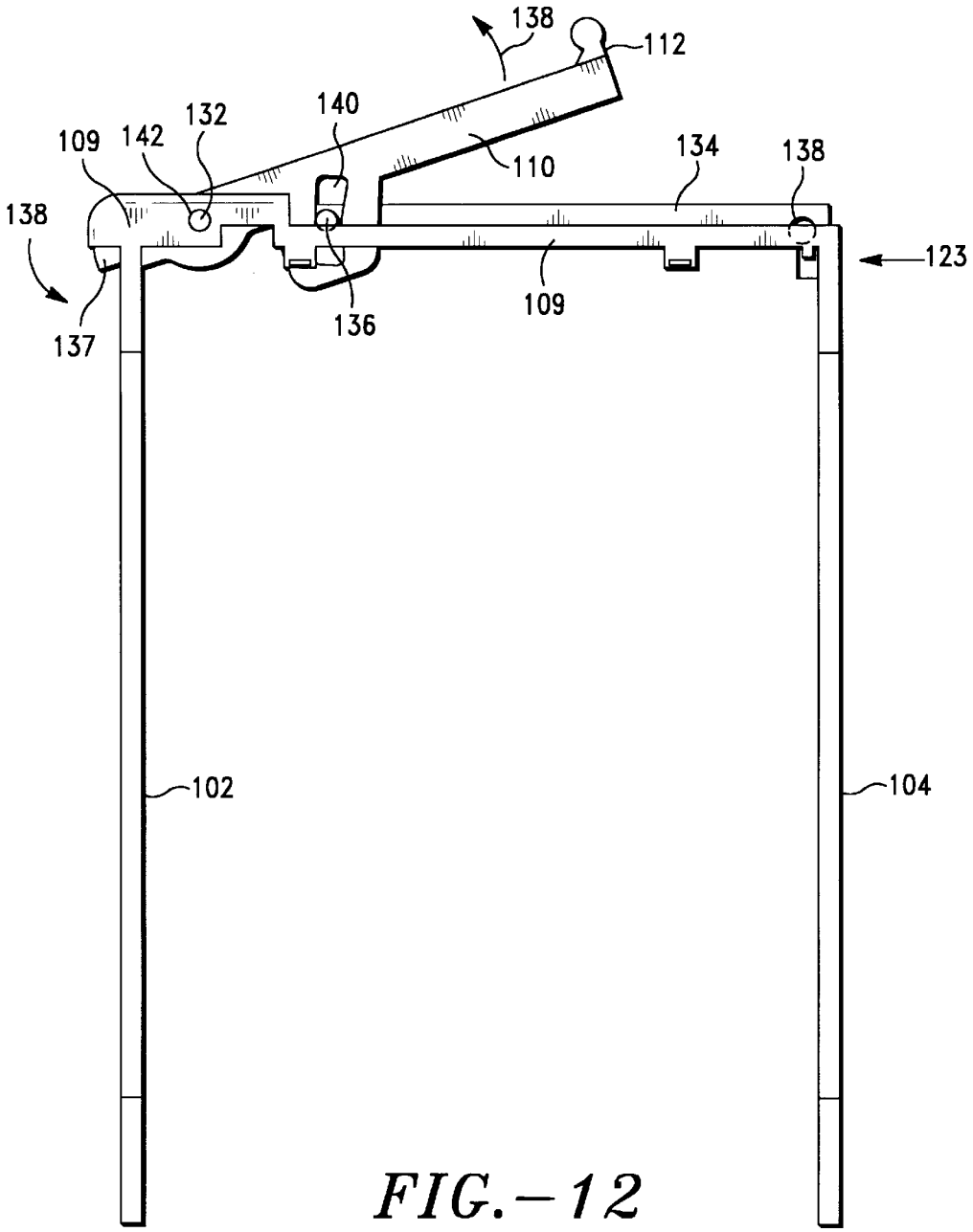
FIG. 12 shows a top plane view of the improved bracket according to the present invention, with the face member removed and the handle in the open position.

FIG. 12 shows a top plane view of the bracket 100 according to the present invention. FIG. 12 is similar to FIG. 8, but for the absence of the face member 106. The pivot member 132 is inserted within a corresponding bore 142 in the frame 109 of the bracket 100, so as to allow the handle 110 to pivot thereabouts. The travel member 136, in FIG. 12, is at the end of its travel within the guide slot 140. In this position, the handle 110 is in its open, locked position.

Figure 13:
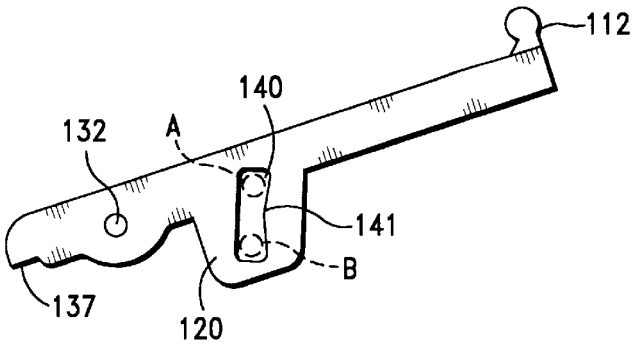
FIG. 13 shows a side view of the handle of the improved bracket according to the present invention, removed from the frame.

FIG. 13 shows a plane view of the handle 110, removed from the frame 109 of the bracket 100. As can be seen in FIG. 13, the guide member 120 of the handle 110 includes a guide slot 140 which constrains the travel of the travel member 136 therein. The guide slot includes an angled portion, shown at 141. As the handle 110 pivots about the pivot member 132, the travel member 136, initially at position "A" in FIG. 12, travels, upon the application of sufficient force, to the position "B" by traveling over and past the angled portion 141 of the guide slot 140. When the travel member 136 is in the "B" position, the handle 110 is in its locked position.

While the foregoing detailed description has described a preferred embodiment of the bracket having a lever in accordance with this invention, it is to be understood that the above description is illustrative only and not limiting of the disclosed invention. In fact, various modifications of the bracket are possible. Such modifications may include, among others, altering the shape of the catch 116 and the ejection member 137, or the manner in which the travel member 136 travels within and is guided by the guide slot 140. Additionally, the configuration of the frame 109 may be altered, or the way in which the handle 110 and the slide member 134 are recessed therein may be changed. Accordingly, the invention as disclosed is to be limited only by the claims as set forth below.

What is claimed:

1. A bracket for removeably attaching a memory storage device to an equipment slide, comprising:

a frame attachable to the memory storage device, the frame including a front portion, a first rail and a second rail;

a handle pivotally mounted to a front portion of the frame, the handle including an ejection member at one end thereof, the handle further including a guide slot;

a slide member having a catch at one end thereof, the slide member having a travel member protruding therefrom, the travel member being inserted in the guide slot, whereby, as the handle is manually pivoted away from the front portion to an open position, the travel member travels within the guide slot and causes the slide member to slide against the front portion, the catch to retract and the ejection member to pivot with the handle to thereby eject the bracket from the slide.

2. A bracket according to claim 1, wherein the catch includes a substantially circular cutout, the cutout rendering the catch resiliently deformable.

3. A bracket according to claim 1, wherein the handle is pivotally attached to the frame by a pivot member inserted within a corresponding bore in the frame member.

4. A bracket according to claim 1, wherein the frame includes a slide member recessed channel to facilitate and constrain the travel of the slide member.

5. A bracket according to claim 1, wherein one portion of the handle is partially recessed within the frame and wherein another portion of the handle is fully recessed within a front surface of the frame, so as to be flush therewith, when the handle is in a closed position.

6. A bracket according to claim 1, further including a face member having snap fit connectors to connect the face member to the front portion of the bracket, the face member constraining the travel of the slide member to slide substantially parallel to the frame front portion.

7. A bracket according to claim 6, wherein the face member includes a handle cutout portion and a front surface cutout portion to accommodate the handle and expose the front surface of the frame, respectively.

8. A bracket for removeably attaching a memory storage device to an equipment slide, comprising:

a frame attachable to the memory storage device, the frame including a front portion, a first rail and a second rail, the front portion including a slide member recessed channel;

a handle pivotally mounted on the front portion of the frame, the handle including an ejection member at one end thereof, the handle further including a guide slot;

a slide member, disposed in the slide member recessed channel, the slide member including a catch at one end thereof and including a travel member proximate another end thereof, the travel member being inserted in the guide slot; and a face member attached to the front surface of the frame, the face member constraining the slide member to slide along the slide member recessed channel, whereby, as said handle is manually pivoted away from the front portion, the travel member travels within the guide slot and causes the slide member to slide against the front portion within the slide member recessed channel, the catch to retract and the ejection member to pivot with the handle to thereby eject the bracket from the slide.

9. A bracket according to claim 8, wherein the catch includes a substantially circular cutout, the cutout rendering the catch resiliently deformable.

10. A bracket according to claim 8, wherein the handle is pivotally attached to the frame by a pivot member inserted within a corresponding bore in the frame member.

11. A bracket according to claim 8, wherein one portion of the handle is partially recessed within the frame and wherein another portion of the handle is fully recessed within a front surface of the frame, so as to be flush therewith, when the handle is in a closed position.

12. A bracket as claimed in claim 8, wherein the face member includes snap fit connectors to connect the face member to the front portion of the bracket.

13. A bracket according to claim 8, wherein the face member includes a handle cutout portion and a front surface cutout portion to accommodate the handle and expose the front surface of the frame, respectively.

14. A bracket for removeably attaching a memory storage device to an equipment slide, comprising:

a frame attachable to the memory storage device, the frame including a front portion, a first rail and a second rail;

a handle pivotally mounted on the front surface of the frame, the handle including an ejection member at one end thereof, the handle further including a guide slot, the guide slot including an angled portion;

a slide member having a catch at one end thereof, the slide member having a travel member protruding therefrom, the travel member being inserted in and being capable of traveling within the guide slot and over the angled portion, whereby, as the handle is manually pivoted away from the front portion, the travel member travels within the guide slot and causes the slide member to slide against the front portion, the catch to retract and the ejection member to pivot with the handle to eject the bracket from the slide, the handle locking into an open position as the travel member travels over and past the angled portion of the guide slot.

15. A bracket according to claim 14, wherein the catch includes a substantially circular cutout, the substantially circular cutout rendering the catch resiliently deformable.

16. A bracket according to claim 14, wherein the handle is pivotally attached to the frame by a pivot member inserted within a corresponding bore in the frame member.

17. A bracket according to claim 14, wherein the frame includes a slide member recessed channel to facilitate and constrain the travel of the slide member.

18. A bracket according to claim 14, wherein one portion of the handle is partially recessed within the frame and wherein another portion of the handle is fully recessed within a front surface of the frame, so as to be flush therewith, when the handle is in a closed position.

19. A bracket according to claim 14, further including a face member having snap fit connectors to connect the face member to the front portion of the bracket, the face member constraining the travel of the slide member to slide substantially parallel to the frame front portion.

20. A bracket according to claim 19, wherein the face member includes a handle cutout portion and a front surface cutout portion to accommodate the handle and expose the front surface of the frame.

* * * * *